US005467094A

United States Patent [19]

Mott et al.

[11] Patent Number: 5,467,094

[45] Date of Patent: Nov. 14, 1995

[54] FLAT ANTENNA LOW-NOISE BLOCK DOWN CONVERTER CAPACITIVELY COUPLED TO FEED NETWORK

[75] Inventors: Richard C. Mott, Mt. Airy; Bernard D. Geller, Gaithersburg, both of Md.

[73] Assignee: Comsat Corporation, Bethesda, Md.

[21] Appl. No.: 266,713

[22] Filed: Jun. 28, 1994

[51] Int. Cl.[6] ..... H01Q 1/38

[52] U.S. Cl. ..... 343/700 MS; 343/829; 343/846

[58] Field of Search ..... 343/700 MS, 829, 343/840, 846

[56] References Cited

U.S. PATENT DOCUMENTS 4,596,047 6/1986 Watanabe et al. ..... 343/840 X 4,623,893 11/1986 Sabbam ..... 343/829 X 5,083,132 1/1992 Kanda et al. ..... 343/700 MS 5,125,109 6/1992 Geller et al. ..... 343/700 MS

*Primary Examiner*—Donald T. Hajec

*Assistant Examiner*—Tho Phan

*Attorney, Agent, or Firm*—Sughrue, Mion, Zinn, Macpeak & Seas

[57] ABSTRACT

Contactless coupling of a low-noise block down-converter (LNB) imbedded within a flat antenna is achieved by mounting the LNB on a power summing/combining network layer of the antenna, and coupling the transition capacitively to the power summing/combining network in a stripline-to-stripline transition. The contactless coupling facilitates antenna manufacture by allowing the rapid testing of the LNB and its final assembly into the antenna.

3 Claims, 5 Drawing Sheets

FLAT ANTENNA LOW-NOISE BLOCK DOWN CONVERTER CAPACITIVELY COUPLED TO FEED NETWORK

BACKGROUND OF THE INVENTION

The present invention relates to flat antennas, and more particularly to structure for connecting a low-noise block down-converter (LNB) electrically to a feed network in flat antennas. Commonly assigned U.S. Pat. No. 5,125,109, which provides relevant background in this particular field, is incorporated herein by reference. Other relevant flat antenna applications and patents include U.S. Pat. Nos. 4,761,654, 4,929,159, and 5,005,019, which also are incorporated herein by reference; and application Ser. Nos. 07/648,459 and 08/126,438, also incorporated herein by reference.

U.S. Pat. No. 5,125,109 discloses an LNB mounted on a power summing/combining network layer in a flat antenna (where the flat antenna acts as a receiver; where the antenna acts as a transmitter, this layer would be a power dividing/distributing network layer.) A coaxial connection and a microstrip/waveguide transition are provided for connecting the LNB to the power summing/combining network layer. While this structure works well, it suffers from two drawbacks, i.e. a difficulty in pre-testing the LNB unit prior to insertion into the antenna, and the time and effort required in final insertion and connection of the unit.

Other work by the assignee in the field, leading to another copending, commonly assigned application Ser. No. 08/115,789, whose disclosure also is incorporated herein by reference, improves upon the techniques disclosed in U.S. Pat. No. 5,125,109 by providing a novel stripline-to-microstrip transition. In accordance with the invention of application Ser. No. 08/115,789, a low noise amplifier (LNA; part of an LNB) is positioned between the ground planes of the antenna so as to take advantage of the symmetry of the E-field in the stripline in providing the transition. However, the same deficiencies exist, relative to the integrity of the electrical connection, as in U.S. Pat. No. 5,125,109.

SUMMARY OF THE INVENTION

In view of the foregoing, it is an object of the present invention to provide an easily disconnectable DC-contactless (DC-blocking) electrical connection for an LNB which simplifies the manufacturing process and thereby reduces the manufacturing cost of the flat antenna. The ability to make a DC contactless RF contact allows rapid, automated, accurate pre-testing of the LNB in an RF environment similar to that in the antenna. After testing, the inventive approach further allows the rapid, automated assembly of the LNB into the final antenna structure.

One connection which the present inventors have found to be highly desirable, and to which the present invention is directed, is a capacitive coupling between the LNB and the power summing/ combining network layer. This development is a natural follow-on to the work in the field of flat antennas which the assignee of this application has conducted over a period of years, and which has led to the above-mentioned U.S. applications and patents, and foreign equivalents thereof.

In a presently preferred embodiment, the inventive structure is constituted by basic flat antenna structure, which includes a ground plane, a power summing/combining network layer, and a receiving element layer. The particular type of receiving element is not of any special significance to the invention; the type used, and its configuration will depend on operational requirements. (Where the flat antenna is used as in transmission, rather than reception, the receiving elements will be radiating elements.) Any type of receiving slot structure, as presently preferred, and as disclosed in the above-mentioned applications and patents, would be acceptable, wherein the receiving slots are capacitively coupled to respective elements in the power summing/combining network layer.

The invention also may be implemented in dual-polarized flat antennas. In that type of implementation, there would be multiple power summing/combining network layers, and multiple receiving element layers, stacked on each other in interleaved fashion. There would be one LNB for each power summing/combining network layer, and capacitively coupled to that power summing/combining network.

The general layout disclosed in U.S. Pat. No. 5,125,109 also is applicable to the present invention, a key difference being the electrical connection between the LNB and the power summing/combining network, as described herein. The general layout disclosed in the above-mentioned copending application Ser. No. 08/115,789 also may be employed beneficially.

BRIEF DESCRIPTION OF THE DRAWINGS

The foregoing and other objects and features of the invention now will be described in detail by way of a preferred embodiment, depicted in the accompanying drawings, in which.

DETAILED DESCRIPTION OF THE PREFERRED EMBODIMENTS

Figure 1:
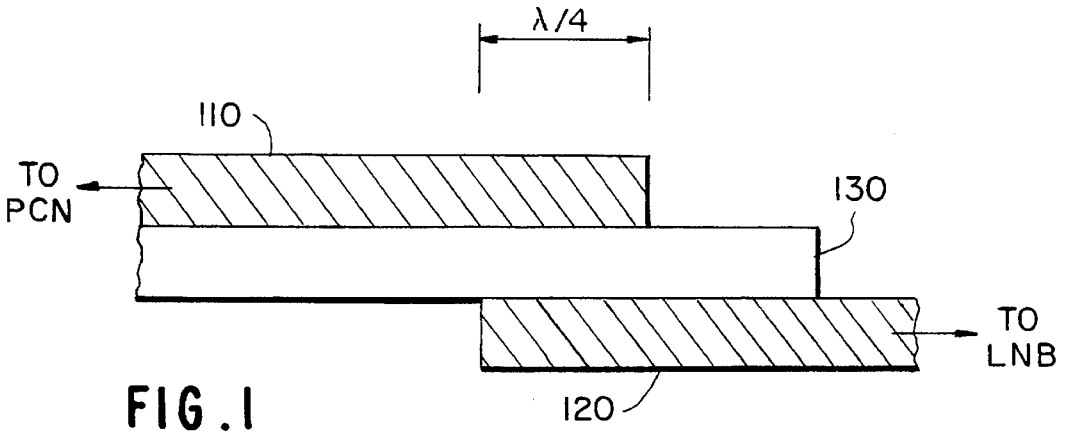
FIG. 1 is a diagram showing generally a connection in accordance with one aspect of the invention.

FIG. 1 shows generally a capacitively coupled connection between a power summing/combining network in a flat antenna and an LNB. The capacitively coupled transmission lines 110, 120 in this embodiment both are implemented in stripline. The amount of overlap between the line 110 (to the power summing/combining network) and line 120 (to the LNB) preferably is $\lambda/4$ at a frequency of 12 GHz in this embodiment. The power summing/combining network, and the line 110 leading therefrom, are provided on a mylar film 130; the stripline connection 120 to the LNB is provided on an underside of the film 130. Thus, the lines 110, 120 do not contact each other physically, but instead are capacitively coupled to each other.

Figure 2A:
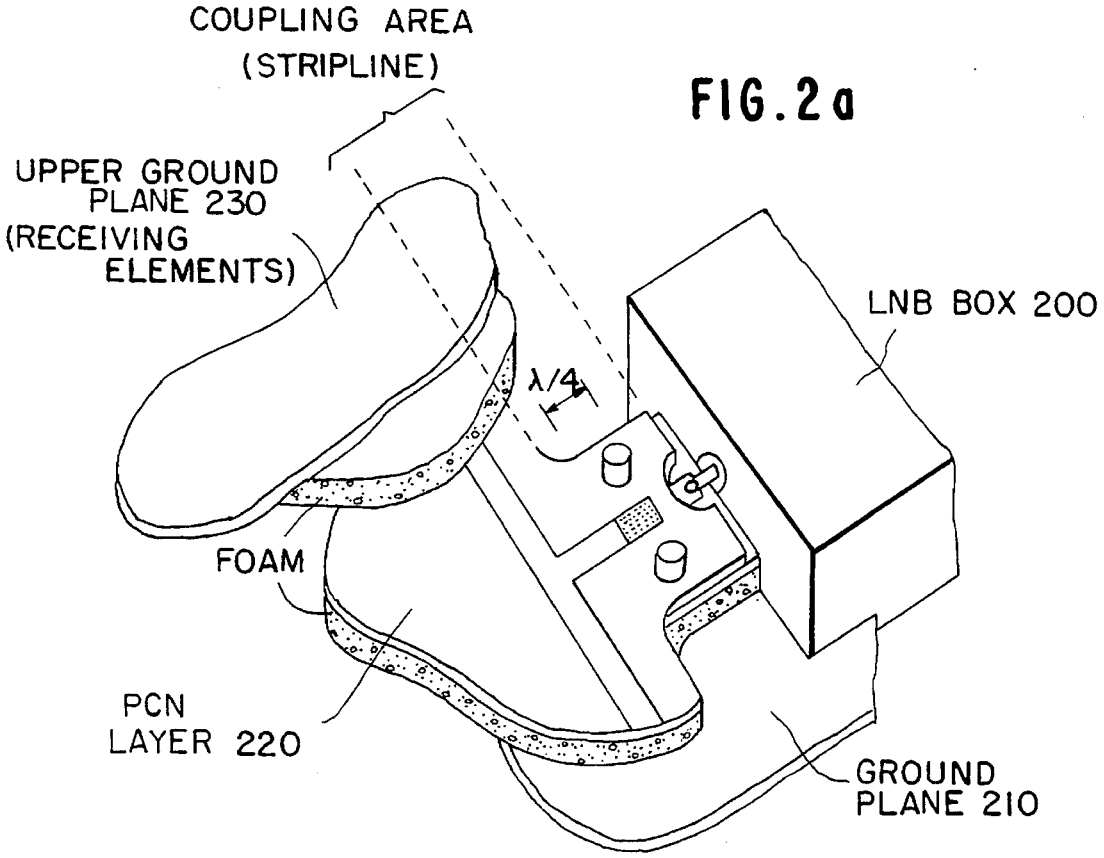
FIGS. 2*a*–2*c* are diagrams showing schematically one approach to mounting the LNB in accordance with the invention.
Figure 2B:
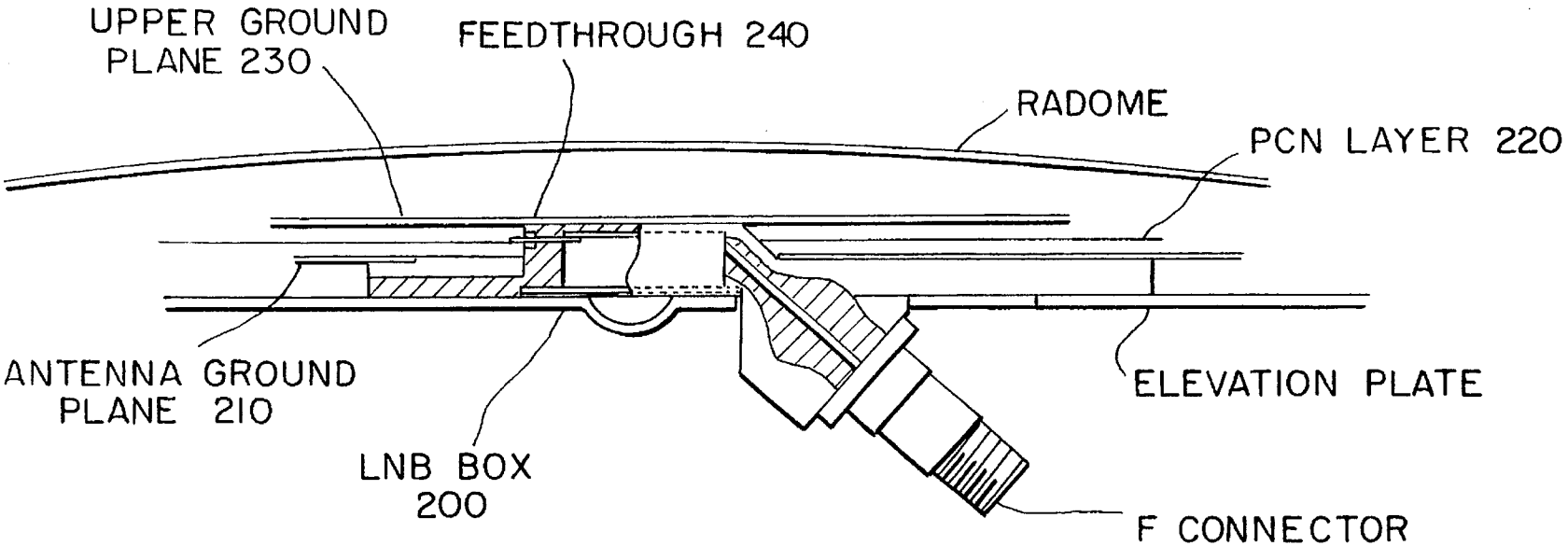
Figure 2C:
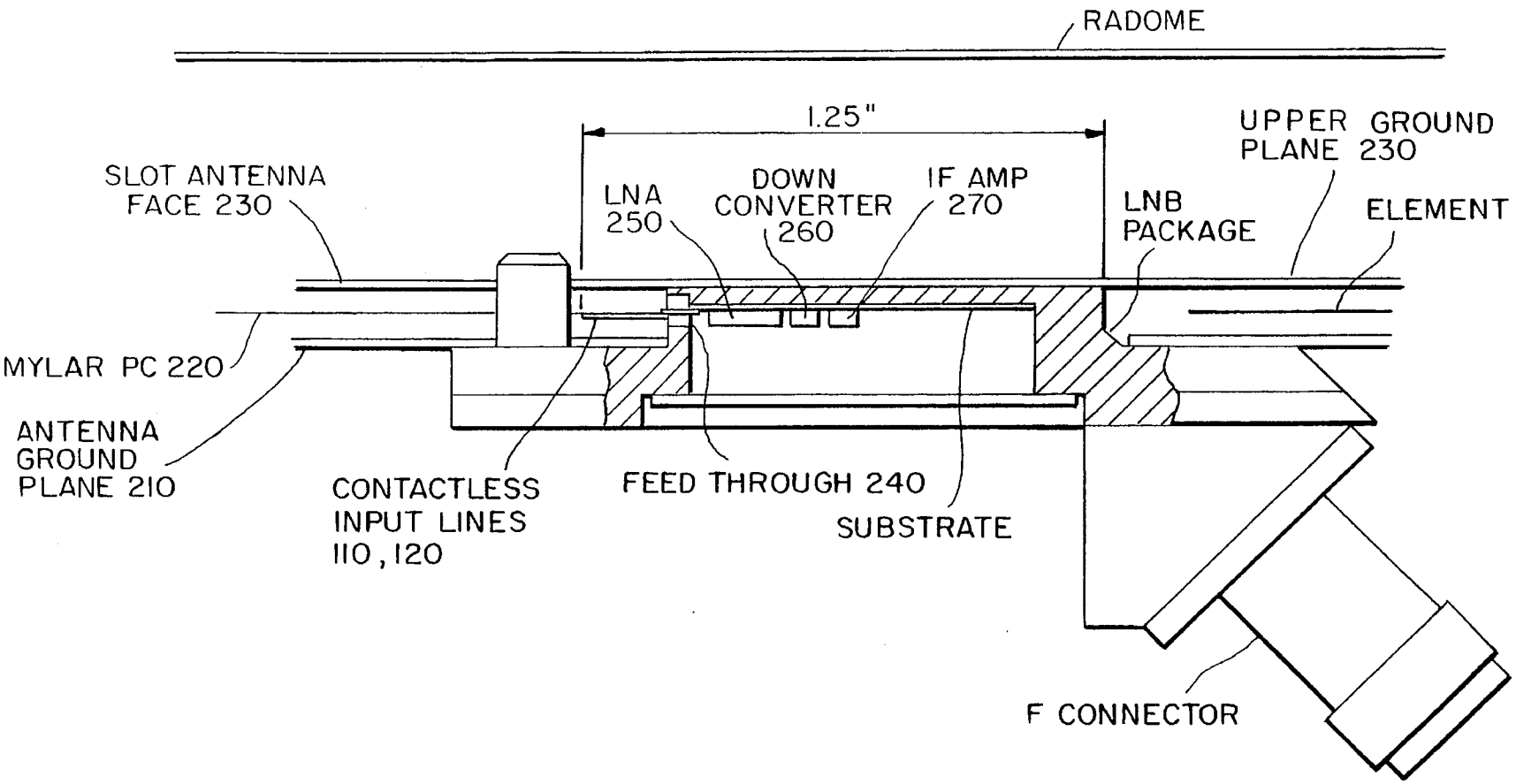

FIGS. 2*a*–2*c* show an approach to mounting the LNB in a flat antenna. As shown, the flat antenna in which the LNB box 200 is mounted has a multi-layer structure, including a ground plane 210, a power summing/combining (PCN) layer 220, and a receiving element layer 230, the receiving element layer 230 acting as a second ground plane. The PCN layer 220 is implemented in stripline, with lines (not shown) feeding the corresponding antenna elements in receiving element layer 230 in a capacitively coupled manner, with no direct contact between the lines and the elements. The receiving element layer 230 acts as a second ground plane.

A feedthrough 240, which could incorporate for example the stripline-to-microstrip approach described in copending application Ser. No. 08/115,789, connects the PCN layer 220, via lines 110, 120, to the LNB 200, which includes LNA 250, down-converter 260, and IF amplifier 270.

As shown in FIGS. 2*a* and 2*b*, the LNB box 200 is mounted between the two ground planes 210, 230. The LNB box 200 preferably is provided at a center of the PCN layer 220, as this provides the lowest loss implementation. With this configuration, it is possible to omit certain ones of the receiving elements toward the center of the receiving element layer 230, and to position the LNB box 200 where these elements are removed. It should be noted that it also is within the contemplation of the invention to mount the LNB box 200 to accommodate situations in which an antenna is tapered (referred to as tapering of the array) in such a manner that certain portions of the array do not contribute greatly to overall performance, i.e. certain elements are not excited or are weakly excited. In such tapered arrays, the feed structure for these unexcited elements may be replaced by the LNB with virtually no loss in performance.

Copending application Ser. No. 07/648,459 discloses a stripline-to=waveguide transition between the PCN layer 230 and the LNB box 200, using a coaxial connection. The above-mentioned application Ser. No. 08/115,789 relating to stripline-to-microstrip transition shows a different type of transition. Depending on the application, the inventive capacitive coupling implemented here may be employed advantageously to either type of approach as desired.

Figure 3:
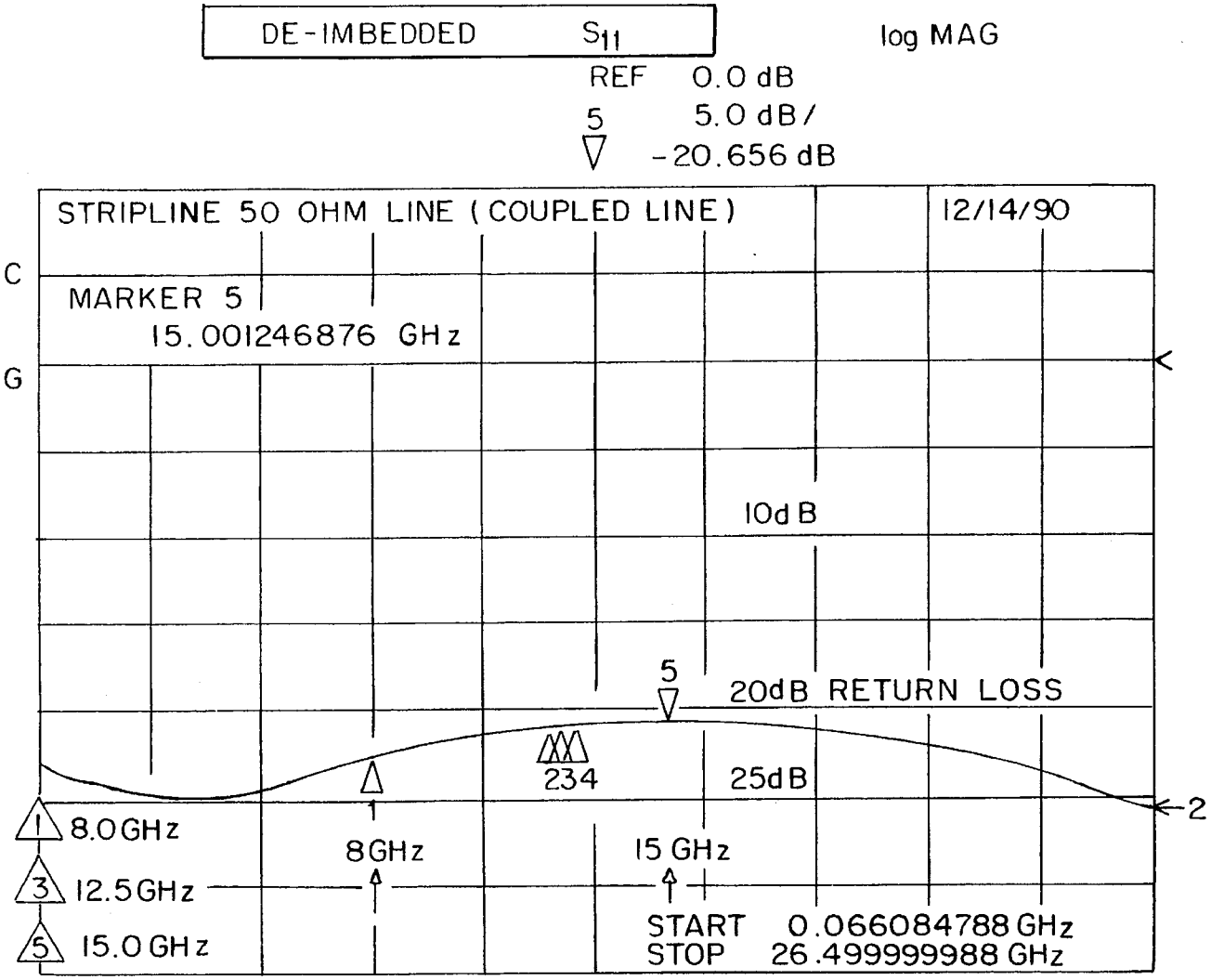
FIG. 3 is a plot showing the return loss of the coupled-line connection to an LNB over the operating frequency band.

FIG. 3 is a graph of the operating return loss of the inventive capacitively-coupled line connection to an LNB over an operating frequency band of 8 GHz to 15 GHz. As can be seen, the capacitively-coupled line connection is well-matched over the entire band.

Figure 4A:
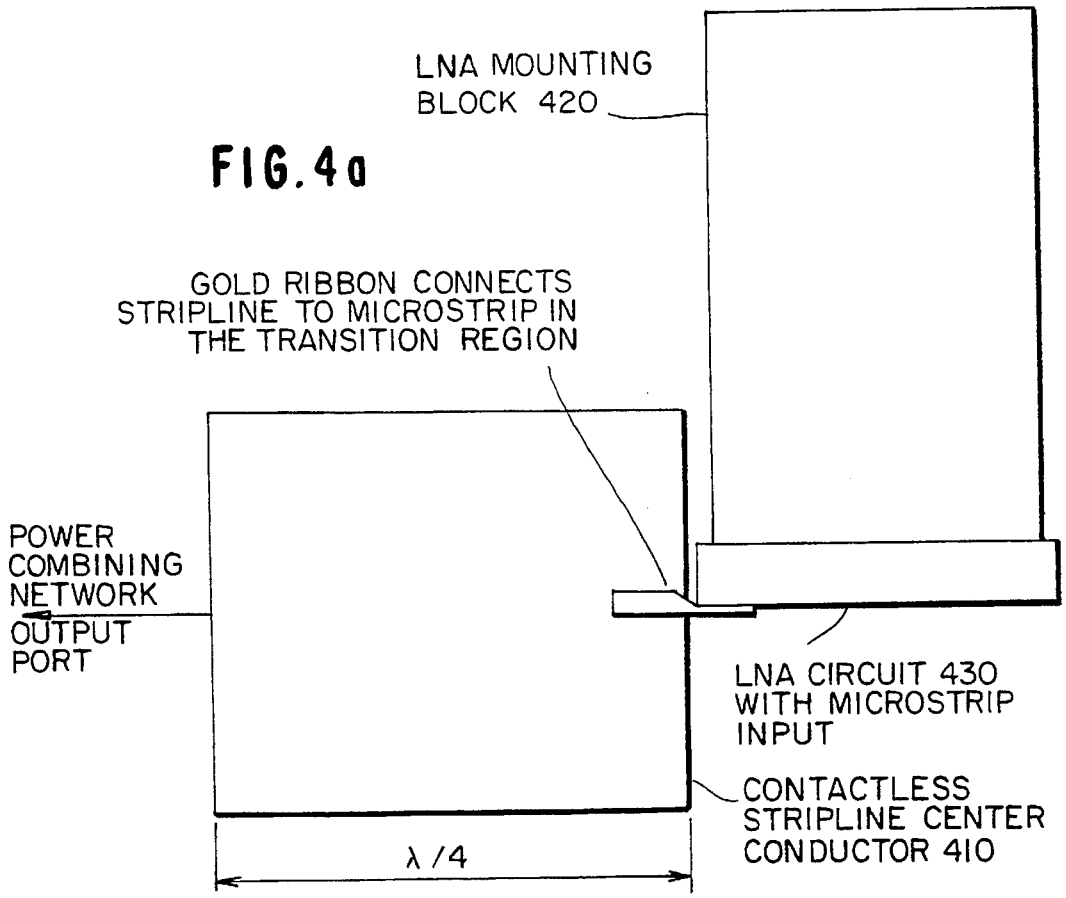
FIGS. 4*a* and 4*b* are diagrams showing schematically another approach to mounting an LNA in accordance with the invention.

FIG. 4*a* shows another mounting approach for an LNA, which takes advantage of the orientation of the E-field in stripline. The Figure shows a top view of a capacitively-coupled transition in which a contactless stripline center conductor 410 is connected to a low noise amplifier (LNA) circuit 430, which is mounted on an LNA mounting block 420. The LNA circuit substrate, which is made of alumina, is 10 mils thick. The stripline center conductor 410 is approximately 212 mils wide and $\lambda/4$ in length in this embodiment, in order to achieve a 50 $\Omega$ characteristic impedance, with a ground plane spacing of 160 mils. An air gap of approximately 5 mils exists between the LNA mounting block 420 and the end of the stripline conductor 410. An air gap of approximately 2 mils exists between the end of the alumina substrate and the end of the stripline 410.

Figure 4B:
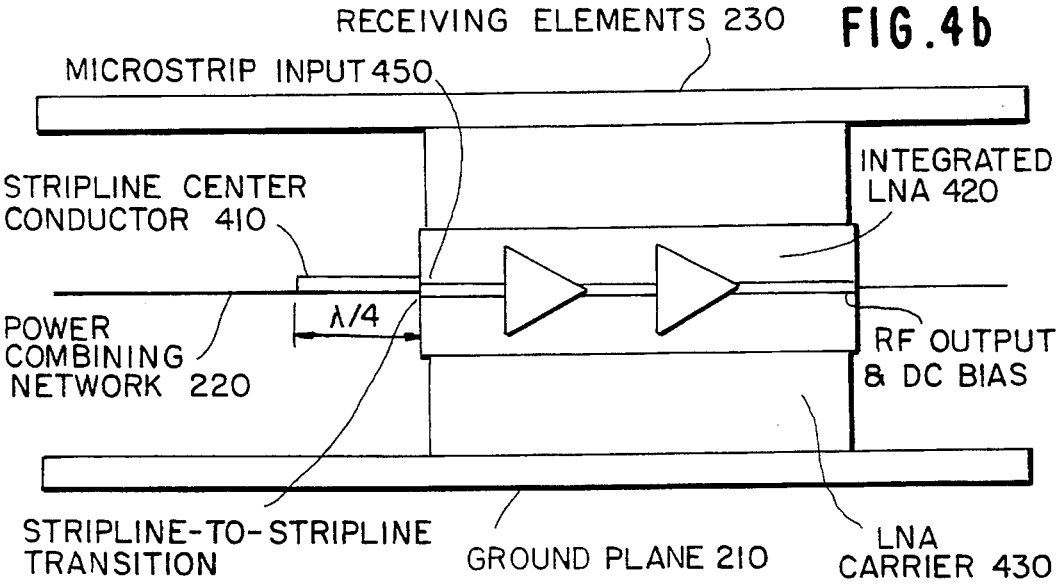

In FIG. 4*b*, a printed circuit antenna includes a ground plane 210, a power combining network 220, and a receiving element array 230 comprised of a plurality of receiving elements (not shown). Individual elements of the power combining network 220 are fed by respective ones of the receiving elements. A low noise amplifier circuit 420, which may for example be a two-stage amplifier, is mounted on a metal block 430 which extends between the ground plane 210 and the receiving element array 230 to provide a low resistance connection. There is a 90° rotation between the stripline conductor 410 and the microstrip 450.

Between the power combining network 220 and the microstrip input 450 is a capcitively-coupled stripline-to-microstrip transition which, as discussed above, may be carried out using the techniques disclosed in application Ser. No. 08/115,789. In accordance with the invention, capacitive coupling is achieved between stripline and stripline, as shown, thus retaining the advantages of the invention.

The vertical metal wall of the carrier block 430 forms a termination of the stripline transmission mode, in which the electric fields are oriented vertically between the two ground planes comprising the ground plane 210 and the receiving element array 230. In the actual transition region, the electric field of the stripline mode is rotated by 90° to the microstrip mode, since the microstrip circuit itself is oriented vertically. The vertical orientation of the amplifier circuit 420 with respect to the power combining network 220 makes it possible to take advantage of the symmetry of the electric field in a stripline transmission mode. The vertical orientation of the amplifier circuit "folds" the upper portions of the field down, and also "folds" the lower portions of the field up, to yield the microstrip electric field configuration.

As in U.S. Pat. No. 5,125,109, in order to have the LNA block mounted on the receiving element array, it is necessary to sacrifice certain ones of the receiving elements which otherwise might be included in the array. Since the elements may be weighted appropriately, the elements to be sacrificed may be selected so as to minimize the effect on performance of the antenna. For example, elements near the center of the antenna may be sacrificed by replacing them with the LNA block.

While preferred embodiments of the invention have been described above in detail, various changes and modifications within the scope and spirit of the invention will be apparent to those of working skill in this technological field. Thus, the invention is to be considered as limited only by the scope of the appended claims.

What is claimed is:

1. A flat antenna comprising:

a ground plane;

a first power combining network layer disposed over said ground plane, said power combining network layer comprising a first power combining network that is fed at a first point, said first power combining network having a first plurality of feedlines extending from said first point;

a first low-noise block down-converter (LNB) extending through said first power combining network layer and capacitively coupled to said first power combining network; and a first receiving element layer disposed over said first power combining network layer and comprising a first plurality of receiving elements, each of said first plurality of feedlines being capacitively coupled to a respective one of said first plurality of receiving elements, said LNB being mounted vertically in said antenna so as to extend between said ground plane and said first receiving element layer through said first power combining network layer.

2. An antenna as claimed in claim 1, further comprising:

a second power combining network layer disposed over said first receiving element layer, said second power combining network layer comprising a second power combining network that is fed at a second point, said second power combining network having a second plurality of feedlines extending from said second point;

a second low-noise block down-converter (LNB) disposed on said second power combining network layer and capacitively coupled to said second power combining network; and a second receiving element layer disposed over said second power combining network layer and comprising a second plurality of receiving elements, each of said second plurality of feedlines being capacitively coupled to a respective one of said second plurality of receiving elements.

3. In a flat antenna comprising a ground plane, a power combining network layer disposed over said ground plane, said power combining network layer comprising a power combining network that is fed at a single point and includes a plurality of feedlines extending from said single point, and a receiving element layer disposed over said power combining network layer, said receiving element layer comprising a plurality of receiving elements, each of said feedlines being capacitively coupled to a respective one of said receiving elements, a low-noise block down-converter (LNB) mounted vertically in said antenna so as to extend through said power combining network layer between said ground plane and said receiving element layer, said LNB having a feed portion that is coupled capacitively to said power combining network layer.

* * * * *